US007540728B2

(12) United States Patent
Gorban

(10) Patent No.: US 7,540,728 B2
(45) Date of Patent: Jun. 2, 2009

(54) METHOD OF TRANSFORMING A MOTION IN A VOLUME SCREW MACHINE OF ROTARY TYPE AND ROTARY SCREW MACHINE

(75) Inventor: Alexander Gorban, Kiev (UA)

(73) Assignee: Elthom Enterprises Limited, Nicosia (CY)

( * ) Notice: Subject to any disclaimer, the term of this patent is extended or adjusted under 35 U.S.C. 154(b) by 0 days.

(21) Appl. No.: 10/521,150

(22) PCT Filed: Jul. 14, 2003

(86) PCT No.: PCT/IB03/03172

§ 371 (c)(1),
(2), (4) Date: Jul. 29, 2005

(87) PCT Pub. No.: WO2004/007965

PCT Pub. Date: Jan. 22, 2004

(65) Prior Publication Data

US 2006/0018779 A1 Jan. 26, 2006

(30) Foreign Application Priority Data

Jul. 17, 2002 (EP) ..... 02291806

(51) Int. Cl.
*F04C 2/10* (2006.01)

(52) U.S. Cl. ..... 418/61.2; 418/61.1; 418/58

(58) Field of Classification Search ..... 418/58, 418/59, 61.2, 61.1, 48
See application file for complete search history.

(56) References Cited

U.S. PATENT DOCUMENTS

| | | | | |
|---|---|---|---|---|
| 2,085,115 | A * | 6/1937 | Moineau | 418/48 |
| 3,299,822 | A * | 1/1967 | Payne | 418/48 |
| 3,338,220 | A * | 8/1967 | Marshall | 417/348 |
| 3,760,777 | A | 9/1973 | Leroy et al. | |
| 3,910,733 | A | 10/1975 | Grove | |
| 3,975,120 | A * | 8/1976 | Tschirky | 418/48 |
| 4,424,013 | A * | 1/1984 | Bauman | 418/61.3 |
| 4,764,094 | A * | 8/1988 | Baldenko et al. | 418/5 |
| 5,108,273 | A * | 4/1992 | Romanyszyn, Jr. | 418/48 |
| 5,439,359 | A * | 8/1995 | Leroy et al. | 418/48 |
| 6,093,004 | A * | 7/2000 | Varadan et al. | 418/48 |
| 2006/0127259 | A1 * | 6/2006 | Gorban | 418/48 |

FOREIGN PATENT DOCUMENTS

| | | | |
|---|---|---|---|
| RU | 2 140 018 C1 | | 10/1999 |
| RU | 2140018 C1 | * | 10/1999 |

* cited by examiner

*Primary Examiner*—Thomas E Denion
*Assistant Examiner*—Mary A Davis
(74) *Attorney, Agent, or Firm*—Connolly Bove Lodge & Hutz LLP; Myron Keith Wyche

(57) ABSTRACT

In order to more effectively use the constructional volume of a volume screw machine of rotary type, a plurality of sets (80, 70; 60, 50) of female elements having an inner screw surface and of male elements having an outer screw surface is provided, wherein in each set a rotary motion of at least one element is created. If the motion of elements in different sets (80, 70; 60, 50) is synchronized, one can provide for a dynamically balanced machine.

14 Claims, 1 Drawing Sheet

METHOD OF TRANSFORMING A MOTION IN A VOLUME SCREW MACHINE OF ROTARY TYPE AND ROTARY SCREW MACHINE

CROSS-REFERENCE TO RELATED APPLICATIONS

This application is a U.S. National Stage entry under 35 U.S.C. §371 of co-pending International Patent Application No. PCT/IB2003/003172, filed on Jul. 14, 2003 by GORBAN, Alexander entitled ROTARY SCREW MACHINE END METHOD OF TRANSFORMING A MOTION IN SUCH A MACHINE, the entire contents of which is incorporated by reference. As in the International Application No. PCT/IB2003/003172, priority is claimed to European Patent Application No. 02291806.4, filed on Jul. 17, 2002, the entire contents of which is incorporated by reference, and for which priority is claimed under 35 U.S.C. §119.

FIELD OF THE INVENTION

The invention relates to a method of transforming a motion in a volume screw machine of rotary type and to such a rotary screw machine.

PRIOR ART

Volume screw machines of rotary type comprise conjugated screw elements, namely an enclosing (female) screw element and an enclosed (male) screw element. The first (female) screw element has an inner screw surface (female surface), and the second (male) screw element has an outer screw surface (male surface). The screw surfaces are non-cylindrical and limit the elements radially. They are centred around respective axes which are parallel and which usually do not coincide, but are spaced apart by a length E (eccentricity).

A rotary screw machine of three-dimensional type of that kind is known from U.S. Pat. No. 5,439,359, wherein a male element surrounded by a fixed female element is in planetary motion relative to the female element.

A first component of this planetary motion drives the axis of the male surface to make this axis describe a cylinder of revolution having a radius E about the axis of the female surface, which corresponds to an orbital revolution motion. That is, the axis of the second (male) element rotates about the axis of the first (female) element, wherein the latter axis is the principal axis of the machine.

A second component of this planetary motion drives the male element to make it rotate about the axis of its screw surface. This second component (peripheral rotation) can also be called swivelling motion.

Instead of providing a planetary motion, a differential motion can be provided. Usually, synchronizing coupling links are used therefor. However, the machines can also be self-synchronized by providing suitable screw surfaces.

Rotary screw machines of volume type of the kind described above are known for transforming energy of a working substance (medium), gas or liquid, by expanding, displacing, and compressing the working medium, into mechanical energy for engines or vice versa for compressors, pumps, etc. They are in particular used in downhole motors in petroleum, gas or geothermal drilling.

In most cases, the screw surfaces have cycloidal (trochoidal) shapes as it is for example known from French patent FR-A-997957 and U.S. Pat. No. 3,975,120. The transformation of a motion as used in motors has been described by V. Tiraspolskyi, "Hydraulical Downhole Motors in Drilling", the course of drilling, p. 258-259, published by Edition TECHNIP, Paris.

The effectiveness of the method of transforming a motion in the screw machines of the prior art is determined by the intensity of the thermodynamic processes taking place in the machine, and it is characterized by the generalized parameter "angular cycle". The cycle is equal to a turn angle of any rotating element (male, female or synchronizing link) chosen as an element with an independent degree of freedom.

The angular cycle is equal to a turn angle of a member with independent degree of freedom at which an overall period of variation of the cross section area (or overall opening and closing) of the working chamber, formed by the male and female elements, takes place, as well as axial movement of the working chamber by one period $P_m$ in the machines with an inner screw surface or by one period $P_f$ in the machines with an outer screw surface.

The known methods of transforming a motion in volume screw machines of rotary type with conjugated elements of a curvilinear shape realized in the similar volume machines have the following drawbacks:

- limited technical potential, because of imperfect process of organizing a motion, which fails to increase a quantity of angular cycles per one turn of the drive member with the independent degree of freedom;
- limited specific power of similar screw machines;
- limited efficiency;
- existence of reactive forces on the fixed body of the machine.

SUMMARY OF THE INVENTION

It is an object of the invention to solve a problem of widening a technical and functional potential capabilities of the method of transforming a motion in screw machines and to increase the specific power and capacity of the screw machines, to decrease the total heat losses, and to decrease reactions on the supports of the volume screw machines.

The invention provides a rotary screw machine comprising at least two sets of conjugated elements, each set comprising a first element having an inner screw surface and enclosed therein a second element having an outer screw surface, wherein the machine comprises an outer set of conjugated elements and at least one inner set of conjugated elements, wherein each inner set of conjugated elements is placed in a cavity of an element of another set of conjugated elements. The sets of conjugated elements are placed coaxially in cavities of each other.

It is to be noted that one element can be part of two different sets. Such an element can have both an outer screw surface and an inner screw surface, thereby being the second element for an outer set of conjugated elements and the first element for an inner set of conjugated elements at the same time. Preferably, the elements are engaged in cavities of each other.

Accordingly, the method of transforming a motion in a volume screw machine makes use of a machine of the type mentioned above, wherein axes of the first and second elements are parallel, and wherein at least one of the first and second elements of each set is rotatable about its axis. According to the invention, a rotary motion of at least one element in each set is created. In a preferred embodiment, a planetary motion of at least one element in each set is created.

The invention therefore uses the machine constructional volume more effectively, providing a higher number of working (displacing) chambers simultaneously, a higher number of working cycles per rotation of a drive shaft, and it thereby increases the efficiency.

According to a preferred embodiment of the invention, the motion of the elements is synchronized in such a manner as to provide for a dynamically balanced machine. It is advisable to mechanically couple the rotatable elements to that end.

This embodiment has the advantage that the machine works more stably, and less effort has to be made for stabilizing the whole machine construction, i.e. the support of the machine does not have to be too heavy and too elaborated.

As mentioned above, the axes of some of the elements of the different sets (which form a first group) coincide (with the principal axis of the machine), whereas the axes of the other elements do not coincide with the principal axis and mostly do not coincide with each other. In most cases, either the first axes of each set of conjugated elements coincide with each other or the second axis of each set of conjugated elements coincide. Only rarely, an embodiment of the machine provides for a structure in which the axis of the first element of a first set of conjugated elements coincides with the axis of the second element of another set of conjugated elements. According to the preferred embodiment, the non-coinciding axes are revolved in such a manner about the coinciding axis (about the principal axis) as to maintain the distance relationship of the non-coinciding axes with regard to each other and with regard to the coinciding axis (the principal axis).

By providing that feature, one can arrange the elements in such a manner that the mass centre (centre of gravity of a slice of the element) of the whole construction is placed in the principal axis. If the distance relationship of the non-coinciding axis is maintained, it is possible to prevent the mass centre from migrating, i.e. from moving. The mass relationship of the elements having non-coinciding axes is thereby maintained, and the elements with coinciding axes do anyhow have their mass centres placed in the principal axis.

That method can be further developed in such a manner that the motion of the elements of different sets of conjugated elements about their respective axes is also synchronized, i.e. the swivelling of the elements is synchronized (in addition to synchronization of their revolution).

There are several possibilities for providing for such a synchronization.

Generally, one can choose two kinds of rotations of the first group of rotations comprising a) the rotation of the first element of one set of conjugated elements about the first axis, b) the rotation of the second element of one set of conjugated elements about the second axis, and c) a rotation of the first axis about the second axis or a rotation of the second axis about the first axis. These two kinds of rotation can then be (mechanically) synchronized each with a respective one of a second group of rotations comprising d) the rotation of the first element of another set of conjugated elements about the first axis, and e) the rotation of the second element of another set of conjugated elements about the second axis.

This embodiment which has been described in a general manner can be split up into four different special preferred embodiments.

In the first preferred embodiment of the method according to the invention, first and second sets of conjugated elements each comprise a planetarily moving element, and the rotations of the axes of the planetarily moving elements of the first and second set are synchronized (revolutions are synchronized), and the rotations of the planetarily moving elements about their axes are synchronized (swivelling is synchronized).

In the second preferred embodiment, first and second sets of conjugated elements each comprise a differential motion, and rotations of the axes of the first elements of the first and second sets are synchronized (revolutions are synchronized), and rotations of the axes of the second elements of the first and second sets are synchronized (other revolutions are also synchronized).

In a third preferred embodiment of the method according to the invention, a first set of conjugated elements comprises a planetary motion and a second set of conjugated elements comprises a differential motion, and rotations of the axes of the first elements of the first and second sets are synchronized (revolutions are synchronized), and rotations of the axes of the second elements of the first and second sets are synchronized (other revolutions are also synchronized).

In a fourth preferred embodiment of the method according to the invention, a first set of conjugated elements comprises a planetary motion and a second set comprises a synchronizing coupling link for providing a differential motion, and a rotation of the axis of an element of the first set of conjugated elements is synchronized with a rotation of the synchronizing coupling link of the second set of conjugated elements.

In all of the embodiments mentioned above, the motion transfer between elements of the groups can be carried out by putting the curvilinear enveloping surfaces of the first and second conjugated elements into mechanical contact thereby forming kinematic pairs.

If a rotary screw machine of the kind discussed above comprises three different sets of elements, one can firstly choose three kinds of state which comprise a) the rotation (or state of immobility) of the first element (female for outer envelope or male for inner envelope) of one set of the three elements about a central fixed axis thereof and the rotation (or state of immobility) of a third element (synchronizer) of one set of the three elements about a central fixed axis thereof, b) a revolution of an axis of the second element (initial trochoid) of one set about a fixed central axis thereof on a synchronizing coupling link, c) swivelling of the second element of one set with the help of a synchronizing coupling link (crank) or a third (male) conjugated screw element which is coaxial to the first one. The above-mentioned three kinds of state can then secondly be (mechanically) synchronized each with a respective one of a second group of state comprising d) the rotation (or state of immobility) of the first element (male for outer envelope or female for inner envelope) of another set of the three conjugated elements about a central fixed axis thereof and the rotation (or state of immobility) of a third element (synchronizer) of another set of the three conjugated elements about a central fixed axis thereof, e) a revolution of an axis of the second element (initial trochoid) of another set about a fixed central axis thereof on a synchronizing coupling link and f) swivelling of the second element of another set.

BRIEF DESCRIPTION OF THE DRAWING

The invention will be more easily apparent from the following description of a preferred embodiment thereof which is described with respect to the drawing, in which.

DESCRIPTION OF A PREFERRED EMBODIMENT

Figure 1:
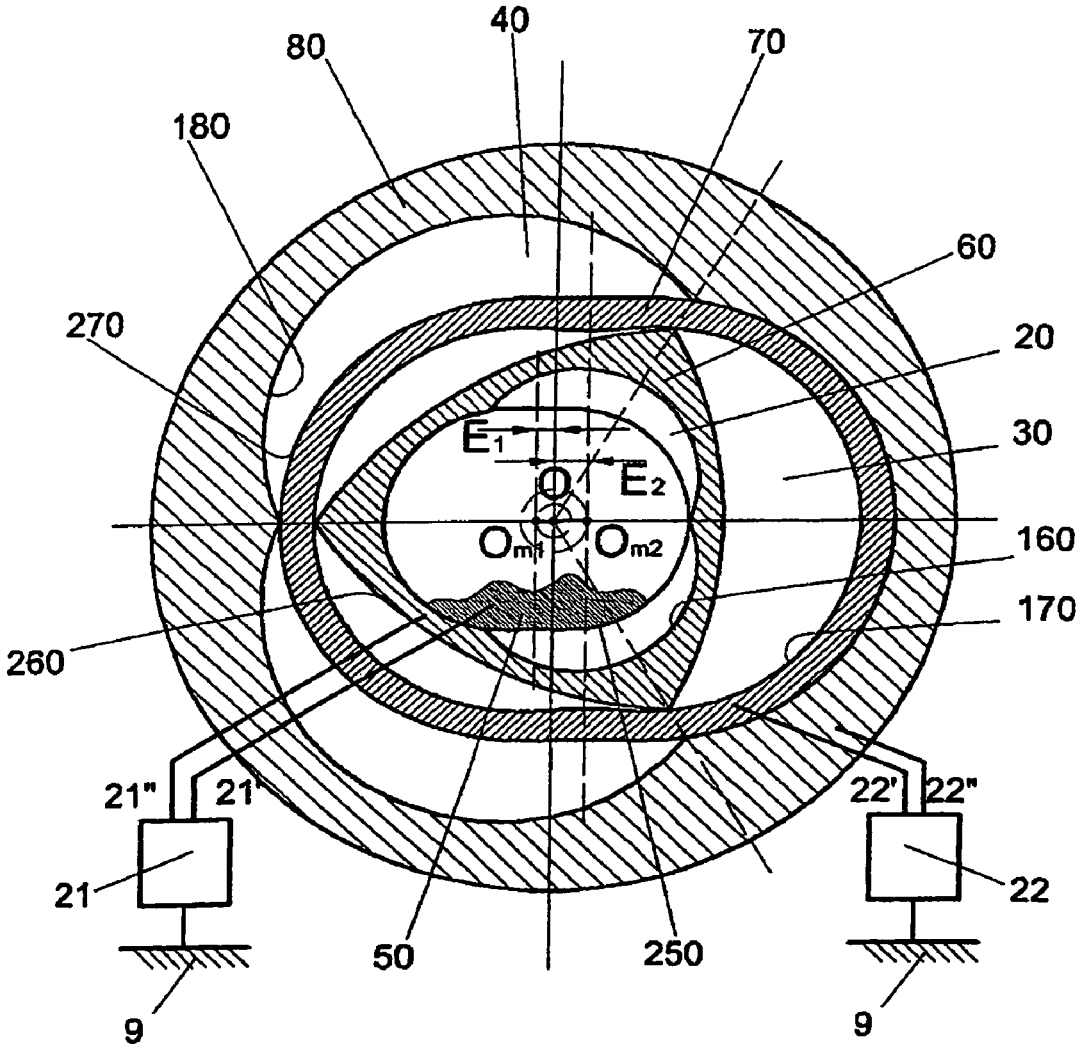
FIG. 1 shows the cross section of a volume screw machine of rotary type according to the present invention which is used to perform the method according to the present invention.

FIG. 1 shows the cross section of a rotary screw machine according to the present invention. In order to increase the efficiency and productive capacity of a three-dimensional screw volume machine, the present machine has more than a single set of male elements (enclosed elements, i.e. elements having an outer screw surface) and female elements (enclosing elements, i.e. elements comprising an inner screw surface). Rather, two sets of conjugated elements 80, 70 on the one hand and 60, 50 on the other hand are engaged one in the other, i.e. an inner set 50, 60 of conjugated screw elements is placed in a cavity of a screw element 70 of a second set of screw elements. The screw elements are set coaxially ("screwed in") in the cavities of each other. In fact, one could also speak of three sets of screw elements because the screw element 70 also acts as a first, enclosing (female) element, and the first element 60 of the other set of conjugated elements 50, 60 also acts as an enclosed (male) element. The elements 70 and 60 therefore also form a set of conjugated elements.

The external element 80 (a female element) with inner screw surface (inner enclosing surface) 180 having a symmetry order $n_f$=3 and conjugated with it element 70 (male element) with outer screw surface (outer enclosed surface) 270 in the form of an initial trochoid having a symmetry order $n_m$=2 form working chambers 40. These elements can be considered as a main set of internally conjugated screw elements which are positioned in such a manner that a centre O of an end section of the first element 80 is coincident with a central longitudinal axis Z of the screw machine, and a centre $O_{m2}$ of the second element 70 is offset by a distance $E_2$ (eccentricity) from axis Z. To control the motion of the first and second elements 80, 70 relative to a fixed main body 9, they are mechanically connected to outlets 22' and 22", respectively, of a control device 22.

The first element 60 (female element) with inner screw surface 160 in the form of an outer envelope having a symmetry order $n_f$=3 and the inner, second element 50 (male element) with outer screw surface 250 in the form of an initial trochoid having a symmetry order $n_m$=2 form working chambers 20. These elements can be considered as an additional set of internally conjugated screw elements positioned in such a manner that a centre O of an end section of the first element 60 is coincident with the central longitudinal axis Z of the screw machine, and a centre $O_{m1}$ of the second element 50 is offset by a distance $E_1$ (eccentricity) from axis Z. To control the motion of the elements 60 and 50 relative to the fixed main body 9, they are mechanically connected to outlets 21' and 21", respectively, of a control device.

An additional inner screw surface 170 of element 70 and an additional outer screw surface 260 of element 60 form additional working chambers 30 such that the total number of working chambers in FIG. 1 is nine. (In the interior of the elements 80 and 60, three working chambers are provided when the elements 70 and 50 are moved with respect to the situation shown in the figure.)

In the general case, the number of pairs of conjugated screw elements can be anyone and is restricted by the overall dimensions of the machine.

A first two-arc element 50 (inner male element) is conjugated with inner three-arcs profile 160 (outer envelope of a family in the form of three-arc profile) of element 60. This inner profile 160 of three-arc element 60 is a female element for the two-arc profile 250 of element 50, but is a male element for the second two-arc element 70 with inner profile 170 (two-arcs initial trochoid). The outer three-arcs profile 260 (inner envelope of a family) of element 60 is conjugated with the inner profile 170 of element 70. It occurs the same with this second two-arc element 70, which is also male and female, and which outer profiles 270 (two-arcs initial trochoid) is engaging in the inner three-arcs profile 180 (outer envelope of a family) of a last three-arc element 80.

In this particular case, the element 70 is mechanically connected to element 50 to swivel about axes passing through centre $O_{m2}$, $O_{m1}$, respectively, and the element 60 is mechanically rigidly connected to the element 80, such that the number of working chambers 20, 30, 40 has increased from three to nine. The inner and outer surfaces 250, 160, 260, 170, 270, 180 are in mechanical contact so as to form these working chambers 20, 30, 40.

In order to mechanically connect elements 50 and 70, one of the two elements 50 or 70 can be hinged on a crank of a synchronizing coupling link $O_{m1}$-O or $O_{m2}$-O passing throughout the body of element 50, whereas both elements 50, 70 simultaneously have no way of doing it. The connection is made in such a manner that the centres $O_{m1}$, $O_{m2}$ are in all cases disposed on one line $O_{m1}$-O-$O_{m2}$ at different sides of the central longitudinal axis Z, so that the elements 50, 70 form a statically and dynamically balanced rotary system of elements. That balance can be provided by selecting the masses of the elements 50, 70, namely in such a manner that the mass centre (centre of gravity of the slices of the element) of the element 70 is placed on the axis passing through the centre $O_{m2}$ and that the mass centre of the element 50 is placed in the centre $O_{m1}$, wherein the mass centre of elements 50 and 70 when taken together is placed in the centre O. In other words, the coupled motion of the elements 50, 70 is performed in such a manner that the mass centre of the elements 50 and 70 when taken together always remains in the centre O and does not migrate.

To generate interconnected motions of elements in sets and at the same time synchronize the motions of elements of different sets, the control devices 21, 22 are introduced. The outlets 21', 21" and 22', 22" of the control devices 21, 22 are mechanically connected to the elements 50, 60 and 70, 80, respectively. According to the invention, the control devices can generate the motions with two degrees of freedom of which one is independent. That is, they can generate a planetary motion of one element of the set around another fixed element. Alternatively, the control devices can generate a motion with three degrees of freedom, i.e. these devices can generate a differentially connected rotation of one element about its fixed axes, any rotary component of a planetary motion-revolution of an axis of the other element about the fixed axis of the first element or swivelling of the second element about its own axis, and a rotation of a synchronizing coupling link $O_{m1}$-O about the fixed axis of the first element. In other words, the motion of set elements with three degrees of freedom is generated of which two degrees can be chosen as independent ones.

In the invention, there are four different variants of transforming a motion of elements of the machine:

a) generation of a revolution of an axis of an element executing a planetary motion (including a circular progressive motion) and generation of a first synchronous revolution of an axis of an element of another set that is analogous to that element, b) generation of a differential motion of the two screw elements of one set and generation of a synchronous differential motion of two analogous screw elements of another set, c) generation of a revolution of an axis of a screw element executing a planetary motion in one set and generation of a synchronous revolution of an axis of a screw element executing a differential motion in another set, d) generation of a differential motion of an external element 60 of an inner set of elements 50, 60 and a synchronizing coupling link $O_{m1}$-O of the inner set or generation of a differential motion of an external element of an outer set 70, 80 and a synchronizing coupling link $O_{m2}$-O of the outer set on the one hand, and generation of a synchronous differential motion of a pair of screw elements of another set on the other hand.

Regarding variant a), the synchronization of the two planetary motions of elements 50 and 70 takes place in the following manner: The control devices 21 and 22 which act in synchronism and in phase generate swivelling to elements 50 and 70 with equal angular velocities $\omega_s$ and with equal rotation phase, and the elements 60 and 80 are retained fixed. Due to self-synchronization, the elements 50 and 70 execute in synchronism a planetary motion during which the surfaces 250 and 270 are rolled out over the surfaces 160 and 180, and the mass centres of the elements 50 and 70 move around circles of radii $E_1$ and $E_2$ as balanced system, wherein the revolution takes place with an angular velocity $\omega_{re}=-2\omega_s$. The vertices of the immovable surface 260 slide over the movable surface 170.

Regarding variant b), the synchronization of the two differential motions of two sets (pairs) of elements 50 and 60 on the one hand and 70 and 80 on the other hand takes place in the following manner: The control devices 21 and 22 act in synchronism and in phase and generate a swivelling with a final angular velocity $\omega_s$ (or provide swivelling with zero velocity, i.e. a circular progressive motion) of the elements 50 and 70 with equal angular velocities and rotation phase, whereas the elements 60 and 80 rotate with a velocity of $\omega_s/2$ about the fixed axis Z. Due to self-synchronization, the elements 50 and 70 execute in synchronism a planetary (or circular progressive) motion, during which the surfaces 250 and 270 are rolled out over the surfaces 170 and 180, and the mass centres of the elements 50 and 70 ($O_{m1}$, $O_{m2}$) move around circles of radii $E_1$ and $E_2$ as balanced system, wherein the revolution takes place with an angular velocity of $\omega_{re}=-\omega_s/2$. The vertices of the surface 260 of the movable element 60 slide over the movable surface 170 of the element 70.

Regarding variant c), it is to be noted that the generation of a revolution of an axis of the screw element 50 executing a planetary motion in one set 50 and 60 and the generation of a synchronous revolution of an axis of a screw element 70 executing a differential motion in another set 70, 80 is made in a manner similar to that described with respect to variants a) and b), but without putting the elements 60 and 70 into contact.

Turning now to variant d), the synchronization of a differential motion of the element 60 and a synchronizing coupling link $O_{m1}$-O with a differential motion of the elements 70 and 80 takes place in the following manner: The control devices 21 and 22 generate for instance a contra-rotary rotation in synchronism and in phase to the two elements 60 and 80 and to the synchronizing coupling link $O_{m1}$-O, i.e. with opposite directions of rotation, but with equal angular velocities, $-\omega_{ro}=\omega_{re}$, and since the surface 250 of the element 50 rolls over the surface 160 of the element 60, a swivelling of the element 50 with an angular velocity of $\omega_s=-2\omega_{re}$ is provided. In this case, the vertices of the movable surface 260 slide over the movable surface 170. Furthermore, it is necessary that the element 50 transmits a swivelling to element 70 in synchronism and in phase, wherein element 70 is rolled over the surface 180 of the movable element 80. The mass centres of the elements 50 and 70 coinciding with the centres $O_{m1}$ and $O_{m2}$ move around circles of radii $E_1$ and $E_2$ as balanced system, wherein the revolution takes place with an angular velocity of $\omega_{re}$, and wherein these centres are placed on one line $O_{m1}$-O-$O_{m2}$ during the whole process of revolution.

The motion transfer between the elements of the sets can be carried out by putting into mechanical contact the curvilinear enveloping surfaces of male and female conjugated elements, thereby forming kinematic pairs.

The angular cycle $T_i$ of pair of female-male conjugated elements is given by equation: $T_i=2\pi/[n_{m,f}|(\omega_f/\omega_i)-(\omega_m/\omega_i)|]$ where: $\omega_f$, $\omega_m$-own angular velocity of female and male elements about own centres; $\omega_i$-angular velocity of independent element, e.g., element executing revolution motion and turn angle of which defines the value of $T_i$; $n_{m,f}$-symmetry order, $n_m$ for hypotrochoid scheme with outer envelope and $n_f$ for epitrochoid scheme with inner envelope.

Regarding said variants:

a) Hypotrochoid scheme (for outer envelope 180) of planetary motion of element 70 (profile 270) with fixed element 80, is defined by the following parameters: $\omega_{f(80)}=0$; $\omega_{re(70)}=1$; $n_{m(70)}=2$; $n_{f(80)}=3$; $\omega_{m(70)}=\omega_{s(70)}=\omega_{re(70)}(1-(n_f/n_m))=1(1-3/2)=-0.5$; $T_{i(re70)}=2\pi/2(0+0.5)=2\pi$; Epitrochoid scheme (for inner envelope 260) of planetary motion of element 70 (profile 170) with fixed element 60, is defined by the following parameters: $\omega_{m(60)}=0$; $\omega_{re(70)}=1$; $n_{m(60)}=3$; $n_{f(70)}=2$; $\omega_{f(70)}=$ $\omega_{s(70)}=\omega_{re(70)}(1-(n_m/n_f))=1(1-3/2)=-0.5$; $T_{i(re\ 70)}=2\pi/2(-0.5-0)=2\pi$;

Regarding said variants:

b) Differential motion: Planetary motion of element 70 (profile 270) and rotation of element 80, is defined by the following parameters: $\omega_{f(ro,80)}=-1$; $\omega_{re(70)}=1$; $n_{m(70)}=2$; $n_{f(80)}=3$; $\omega_{m(70)}=\omega_{s(70)}=(\omega_f-\omega_{re})(n_f/n_m)+\omega_{re}=(-1-1)(3/2)+1=-2$; $T_{i(re,70)}=2\pi/2(-1+2)=\pi$; Differential motion: Planetary motion of element 70 (profile 170) and rotation of element 60, is defined by the following parameters: $\omega_{m(ro,60)}=-1$; $\omega_{re,70}=1$; $n_{m(60)}=3$; $n_{f(70)}=2$;$\omega_{f(s,70)}=\omega_{s(70)}=(\omega_m-\omega_{re})(n_m/n_f)+\omega_{re}=(-1-1)(3/2)+1=-2$; $T_{i(re,70)}=2\pi/2(-2+1)=\pi$; From the above it is evident that, in case of differential motion of elements, angular cycle twice decreases and accordingly the efficiency of method increases.

The direction of axial movement of working medium along axis Z in each set of chambers 40, 30 and 20 is defined by the direction of revolution of centres $O_{m1}$, $O_{m2}$, therefore in order to choose the same directions of working medium movement, control devices 21, 22 give the same directions of revolution of centres $O_{m1}$, $O_{m2}$, and in order to choose the opposite directions of working medium movement in chambers 40, 30 and 20, control devices 21, 22 give the opposite direction of revolution of centres $O_{m1}$, $O_{m2}$.

It is to be noted that the working medium is transported along the Z axis in the working chambers of the element sets. If the direction of that axial movement is to be changed, one has to change the direction of revolution of the centres $O_{m1}$, $O_{m2}$ of the elements executing planetary motion in the sets.

The invention claimed is:

1. A method of transforming a motion in a volume screw machine, said machine having at least two sets of conjugated elements (80, 70; 60, 50), each of the sets further comprising:

a first element (80, 60) having an inner screw surface (180, 160) centered around a first axis passing through center O; and a second element (70, 50) having an outer screw surface (270, 250) centered around a second axis passing through centers $Om_2$, $Om_1$ of the respective set of conjugate elements, wherein the first element has a symmetry order $n_f$=3 and the second element has symmetry order $n_m$=2, wherein an inner set (50, 60) of the conjugated elements is placed coaxially in at least one cavity of the second element of an outer set (80, 70) of conjugated elements, wherein the first and second axes passing through the centers O, $Om_1$, and $Om_2$ are parallel and distances E1 and E2, from the respective second axes, are offset in opposite directions relative to the center O, wherein at least one of said first and second elements of each set is rotatable about its axis, said method comprising:

creating a rotary motion of at least one element in each of the sets.

2. The method of claim 1, wherein the rotary motion of said at least one element in each set is synchronized in such a manner as to provide for a dynamically balanced machine.

3. The method of claim 1, wherein each set comprises an element centered about an axis which coincides with a principal axis of the machine, and wherein the respective second element of each set is centered about an axis which is not coinciding with the principal axis, wherein the non-coinciding axes are rotated in such a manner about the principal axis as to maintain the distance relationship of the non-coinciding axes with regard to each other and with regard to the principal axis.

4. The method of claim 1, wherein said first axes of each set of conjugated elements coincide, whereas the second axes are non-coinciding, or that said second axes of each set of conjugated elements coincide whereas the first axes are non-coinciding, and that the non-coinciding axes passing through the centers $Om_1$, $Om_2$ are rotated in such a manner about the coinciding axes passing through the center O as to maintain the distance relationship of the non-coinciding axes passing through the centers $Om_1$, $Om_2$ with regard to each other and with regard to the coinciding axes passing through the center O.

5. The method of claim 2, wherein a motion of the elements of different sets of conjugated elements about their respective axes is synchronized.

6. The method of claim 1, wherein, of a first group of rotations comprising:

a) the rotation of the first element of one set of conjugated elements about the first axis, b) the rotation of the second element of one set of conjugated elements about the second axis, and c) a rotation of the first axis about the second axis or a rotation of the second axis about the first axis, at least two rotations are mechanically synchronized each with a respective one of a second group of rotations comprising:

d) the rotation of the first element of another set of conjugated elements about the first axis, and e) the rotation of the second element of another set of conjugated elements about the second axis.

7. The method of claim 6, wherein first and second sets of conjugated elements each comprise a planetarily moving element, and wherein the rotations of the axes of the planetarily moving elements of the first and second sets are synchronized, and wherein the rotations of the planetarily moving elements about their respective axes are synchronized.

8. The method of claim 6, wherein first and second sets of conjugated elements each comprise a differential motion, and wherein rotations of the axes of the first elements of the first and second sets are synchronized, and wherein rotations of the axes of the second elements of the first and second sets are synchronized.

9. The method of claim 6, wherein a first set of conjugated elements comprises a planetary motion and a second set of conjugated elements comprises a differential motion, and wherein rotations of the axes of the first elements of the first and second sets are synchronized, and wherein rotations of the axes of the second elements of the first and second sets are synchronized.

10. The method of claim 6, wherein a first set of conjugated elements comprises a planetary motion and a second set comprises a synchronization coupling link ($Om_1$-O, $Om_2$-O) for providing a differential motion, and wherein a rotation of the axis of an element of the first set of conjugated elements is synchronized with a rotation of the synchronizing coupling link of the second set of conjugated elements.

11. The method of claim 1, wherein curvilinear inner surfaces (180, 170, 160) of the first elements (80, 70, 60) are put into mechanical contact with curvilinear outer surfaces (270, 260, 250) of the second elements (70, 60, 50), thereby carrying out said motion transfer.

12. A volume screw machine of rotary type, comprising at least two sets of conjugated elements (80, 70; 60, 50), each set further comprising:

a first element (80, 60) having an inner screw surface (180, 160) and enclosed therein a second element (70, 50) having an outer screw surface (270, 250), wherein the first element has a symmetry order $n_f$=3 and the second element has symmetry order $n_m$=2, and said conjugated elements of said machine further comprising:

an outer set of conjugated elements (80, 70); and at least one inner set of conjugated elements (60, 50), wherein each inner set of conjugated elements (60, 50) is placed in a cavity of an element of another set of conjugated elements.

13. The screw machine of claim 12, wherein rotatable elements of the different sets of conjugated elements are mechanically coupled to each other such as to provide for a synchronized motion of said elements.

14. A method of transforming a motion in a volume screw machine, said machine having at least two sets of conjugated elements, each set comprising:

a first element having an inner screw surface centered around a first axis passing through center O; and a second element having an outer screw surface centered around a second axis passing through centers $Om_2$, $Om_1$ of the respective set of conjugate elements, wherein the first element has a symmetry order $n_f$=3 and the second element has $n_m$=2, wherein an inner set of the conjugated elements is placed coaxially in at least one cavity of the second element of an outer set conjugated elements, wherein the first and second axes passing through the centers O, $Om_1$, and $Om_2$ are parallel and distances E1 and E2, from the respective second axes, are offset in opposite directions relative to the center O, wherein at least one of said elements of each set is rotatable about its axis, said method comprising:

creating a rotary motion of at least one element in each set of conjugated elements, each set further comprising an element centered about an axis which coincides with a principal axis of the machine, the respective second element of each set being centered about an axis which is not coinciding with the principal axis, and the non-coinciding axis being rotated in such a manner about the principal axis as to maintain the distance relationship of the non-coinciding axes with regard to each other and with regard to the principal axis.

* * * * *